US005766456A

United States Patent [19]

Denkewicz, Jr. et al.

[11] Patent Number: 5,766,456

[45] Date of Patent: Jun. 16, 1998

[54] WATER PURIFER FOR A POOL

[75] Inventors: Raymond P. Denkewicz, Jr., Warwick, R.I.; Peter P. Yurchision, Shavertown, Pa.

[73] Assignee: Fountainhead Technologies, Inc., Providence, R.I.

[21] Appl. No.: 675,400

[22] Filed: Jul. 2, 1996

[51] Int. Cl.[6] ..... E04H 4/16

[52] U.S. Cl. ..... 210/169; 210/199; 210/205; 210/209

[58] Field of Search ..... 210/169, 192, 210/198.1, 199, 205, 209, 416.2

[56] References Cited

U.S. PATENT DOCUMENTS

| | | | |
|---|---|---|---|
| 3,677,408 | 7/1972 | Dinizo, Jr. . | |
| 4,540,489 | 9/1985 | Barnard . | |
| 5,221,444 | 6/1993 | Silveri | 210/169 |
| 5,332,511 | 7/1994 | Gay et al. | 210/764 |
| 5,352,367 | 10/1994 | Heinig, Jr. | 210/764 |
| 5,389,210 | 2/1995 | Silveri . | |
| 5,401,373 | 3/1995 | Silveri | 210/169 |
| 5,580,438 | 12/1996 | Silveri | 210/169 |

OTHER PUBLICATIONS

International Search Report mailed Oct. 2, 1997 in connection with PCT/US97/09322

*Primary Examiner*—Neil McCarthy
*Assistant Examiner*—Theodore McEwan Green
*Attorney, Agent, or Firm*—Dean W. Russell; Kilpatrick Stockton LLP

[57] ABSTRACT

The invention features a water purifier for purifying water in a pool having a volume less than about 13,500 gallons. In general, the water purifier has a threaded fitting that allows it to be removably-attached to a water-exchange fitting, preferably on the side of the pool. The water purifier contains a purification material for purifying the water. The purification material preferably can be a silver-containing material.

24 Claims, 4 Drawing Sheets

WATER PURIFER FOR A POOL

BACKGROUND OF THE INVENTION

The invention relates to water purifiers.

It is important to have a reliable method for purifying water in swimming pools. In many situations, water is purified to remove micro-organisms, such as bacteria or algae, and harmful metal ions, such as mercury, lead and copper. Purification of pool water can be accomplished by filtration and by adding chemicals like chlorine, bromine, or silver ions to the water.

One type of above-ground pool, commonly known as a "splash pool," is relatively inexpensive and typically has a volume of less than about 7,500 gallons. A splash pool usually has a low horsepower pump, e.g., between 1/25 and ½ horsepower, for recirculating water in the pool. The pool water can be filtered and is ordinarily purified by adding chlorine.

SUMMARY OF THE INVENTION

The present invention features a water purifier for purifying water in a pool having a volume less than about 13,500 gallons. In general, the water purifier has a threaded fitting that allows it to be removably-attached to a water-exchange fitting, preferably on the side of the pool. The threaded fitting on the water purifier preferably is male-threaded and the water-exchange fitting preferably is female-threaded. The water purifier contains a purification material for purifying the water. The purification material-preferably can be a silver-containing ceramic material.

The water purifier preferably includes a housing having a chamber for containing the purification material. The housing also includes a water inlet and a water outlet. The housing preferably has a height of less than 6 inches, and, more preferably, less than 3 inches. The chamber preferably has an internal volume of at least 30 cubic centimeters, preferably between 30 and 100 cubic centimeters, and more preferably between 40 and 80 cubic centimeters.

The water purifier preferably has an exposed surface having rounded edges. The water purifier preferably is circular and has a diameter of between 3 and 12 inches, most preferably about 4½ inches. The height of the water purifier can be less than 6 inches, and is preferably less than 3 inches. Most preferably, the height is about 1¼ inches.

The water purifier can provide one or more of the following advantages. Since the water purifier can be removably-attached to a water-exchange fitting that is part of the circulation system of the pool, the water purifier can be used without modification of the plumbing system of the pool. In addition, when the purification material is silver-containing material, the water can be effectively purified using oxidizing agents other than chlorine alone (e.g., potassium peroxymonosulfate).

Further, when the purification material is a monolithic ceramic foam with large pore sizes or is formed as large pieces that cannot fall through openings in the water exit of the purifier. Generally, the ceramic foam has between 10 and 45 pores per inch, preferably between 10 and 25 pores per inch. The large pieces of purification material are generally between 1 and 30 mesh in size, preferably between 5 and 15 mesh, and most preferably between 7 and 14 mesh. When the water purifier includes a door, the purification material can be exchanged easily without replacing the entire water purifier. Since the purification material preferably has a large pore size or is formed of relatively large particles, the preferred water purifier exerts little or no back-pressure on the filter as water is circulated.

The water purifier is suitable for purifying water in small swimming pools, particularly above-ground pools with volumes less than about 13,500 gallons. It is particularly suitable for use in splash pools. It is preferred that the water purifier receive filtered water.

The term "circulated," as used herein, means continuous flow of the water to expose the water to the water purifier, for example, as it is pumped through a filter.

Other advantages and features of the invention will be apparent from the description of the preferred embodiment, and from the claims.

DETAILED DESCRIPTION

Figure 1:
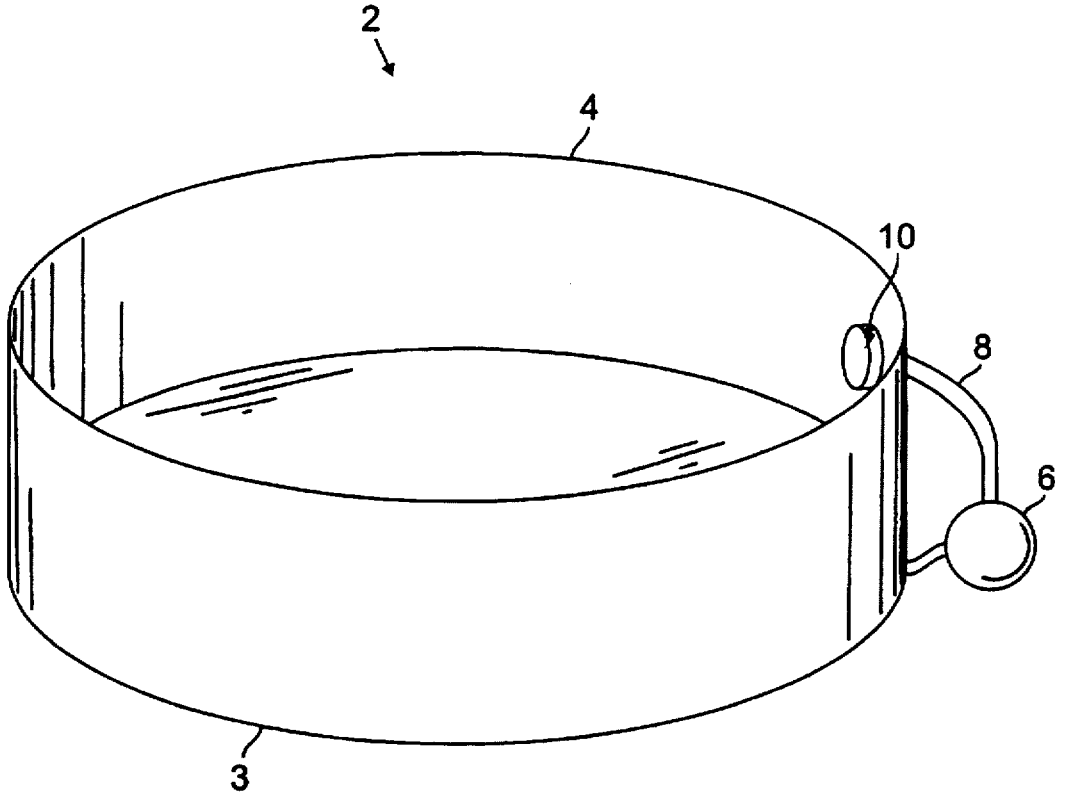
FIG. 1 is a perspective view of a pool including a water purifier.

Referring to FIG. 1, splash pool 2 has a bottom 3 and wall 4 which define the volume of the small above-ground pool. The volume of splash pool 2 is less than 7,500 gallons. Water is circulated in splash pool 2 by pump 6, which is attached to the side of the pool by conduit 8. Water is circulated by a pump from an intake fitting to the discharge fitting through conduit 8. The water can be filtered during circulation. Water purifier 10 receives water that is pumped by pump 6.

Figure 2:
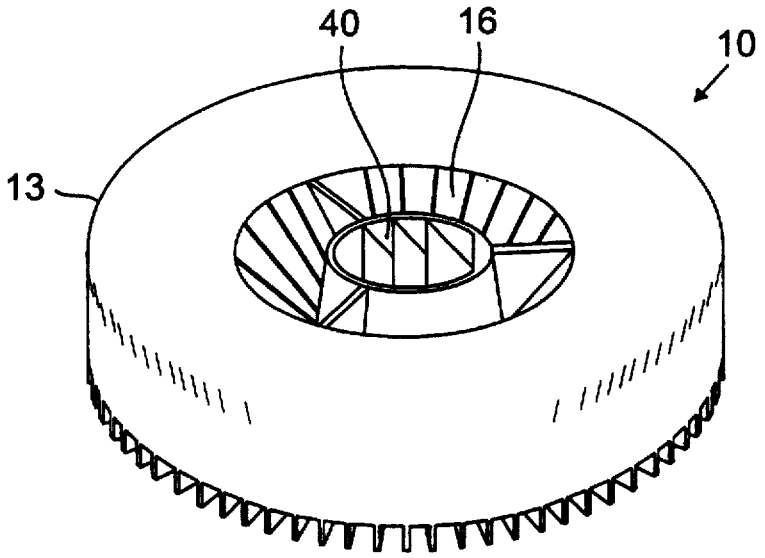
FIG. 2 is a perspective view of the top of a water purifier.
Figure 3:
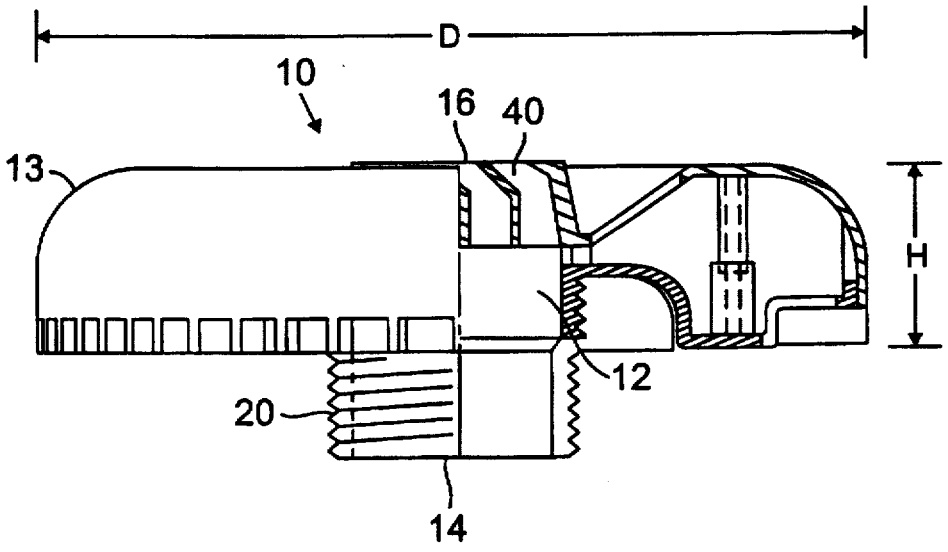
FIG. 3 is a side view of the water purifier, with a cut-away view of the inner space of the purifier.

Referring to FIGS. 2 and 3, water purifier 10 has a chamber 12, located inside circular housing 13, for containing a purification material (not shown) that kills bacteria in water. Chamber 12 has an internal volume of 50 cubic centimeters. Water purifier 10 has a water inlet 14 that permits water to enter chamber 12, and a water outlet 16 that permits water to exit the chamber. Water outlet 16 has openings 40.

The circular housing 13 has a diameter (D) of 4½ inches. The housing 13 has a height (H) of about 1¼ inches. Water purifier 10 generally can be made of a plastic or other suitable material, like PVC, polyethylene, polypropylene, or other moldable plastics.

Figure 4:
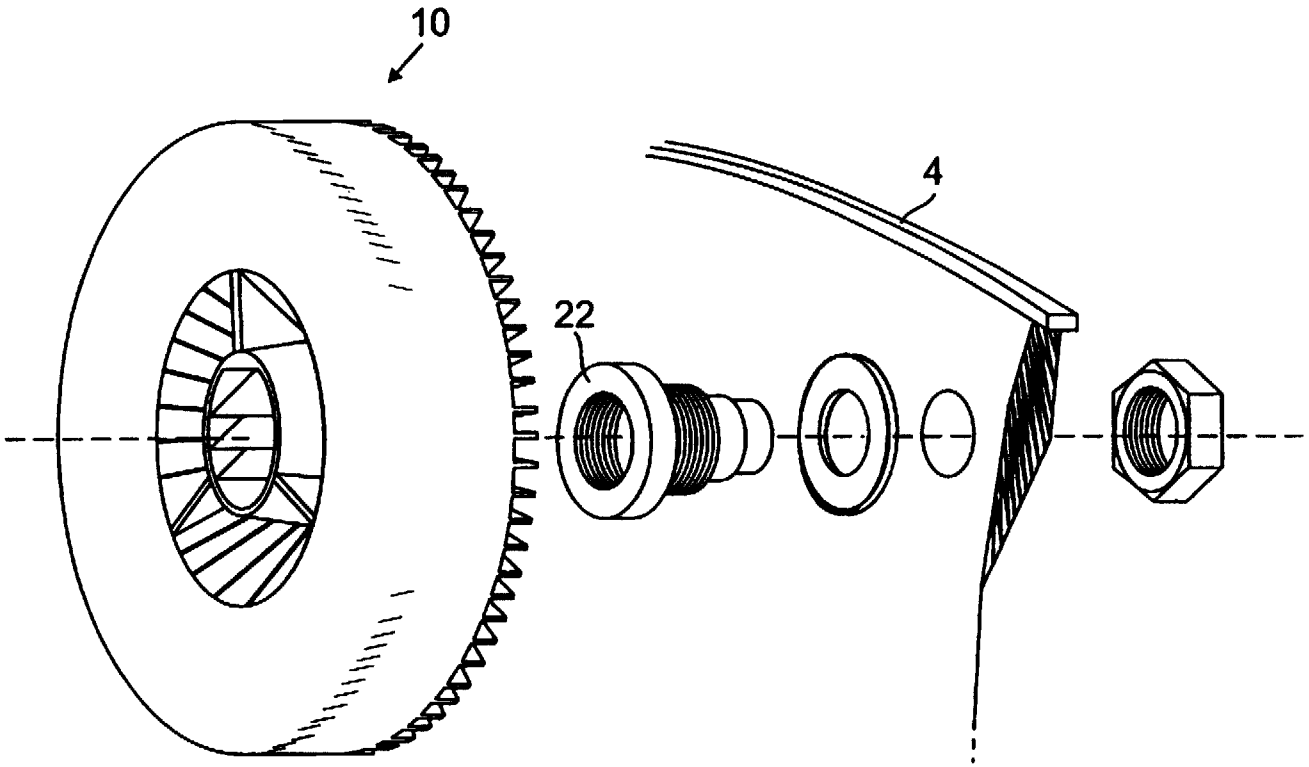
FIG. 4 is an exploded view of the water purifier and a female-threaded water-exchange fitting in the wall of the pool.

Referring to FIG. 4, water purifier 10 is removably-connected to female-threaded water-exchange fitting 22 through male-threaded fitting 20. Water-exchange fitting 22 extends through pool wall 4. When water purifier 10 is connected to fitting 22, a surface of water purifier 10 is substantially contiguous (i.e. adjacent) to pool wall 4 (see, e.g., FIGS. 1 and 4).

Figure 5:
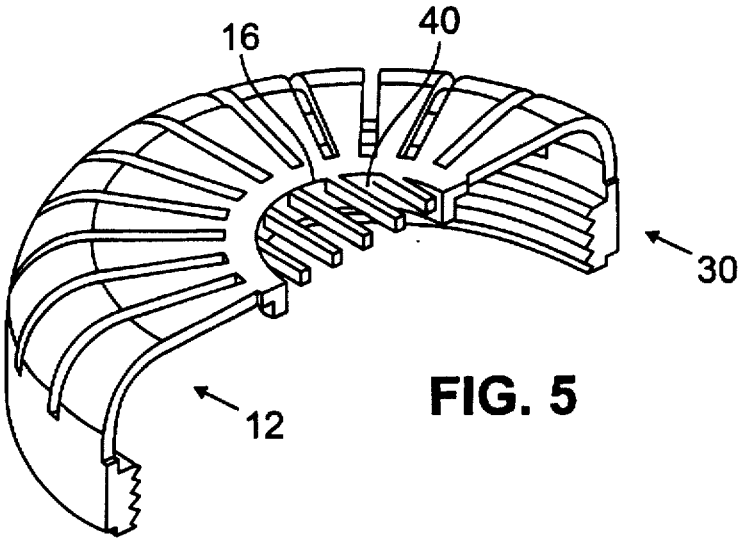
FIG. 5 is a top view of a second water purifier.
Figure 6:
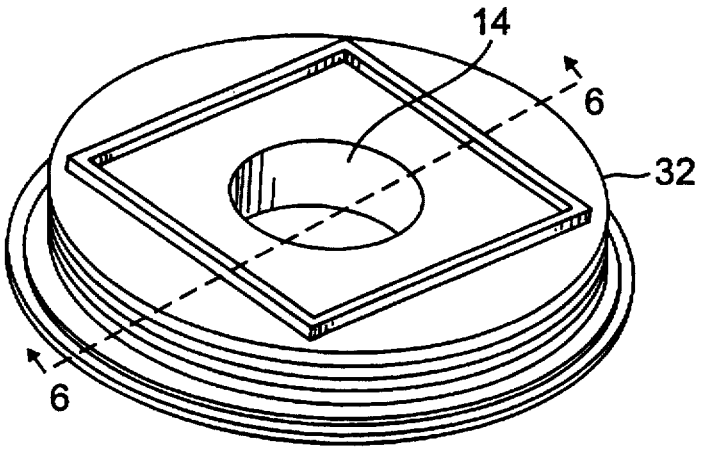
FIG. 6 is a bottom view of the second water purifier.
Figure 7:
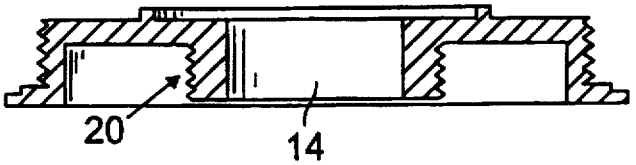
FIG. 7 is a cross-section of the bottom of the second water purifier.

Referring to FIGS. 5–7, an alternate water purifier has a top 30 and a bottom 32 which serves as an access through which the purification material can be added, removed, or replaced. Top 30 has a space that serves as chamber 12. Bottom 32 includes water inlet 14 that has male-threaded fitting 20 that screws into the female-threaded water-exchange fitting 22 of the pool.

The preferred purification materials are described, for example, in U.S. Pat. No. 5,352,369 and in U.S. Ser. No. 08/628,405, entitled "Self-Regulating Water Purification Composition" and filed Apr. 5, 1996, which are incorporated herein by reference. Examples of these purification materials include silver metal on a support. The support can be a ceramic and can include an inorganic oxide, e.g., an aluminum oxide. The silver can be chemically deposited on the ceramic support or dispersed as a powder, shavings, or turnings with the ceramic support. The preferred silver content of the purification material is between 0.1 and 10 weight percent. The purification material can include a second metal, preferably zinc, copper, aluminum, iron, or manganese, most preferably, zinc.

The purification material is preferably formed into particles larger than the individual openings 40 in the water purifier, e.g., as pellets or as a monolithic foam, so that the material is adequately contained in chamber 12. Alternatively, the purification material can be contained in a porous container, for example, a mesh bag.

It is preferred that the purification material be used in the presence of oxidizing agents dissolved in the water, such as, for example, ozone, potassium peroxymonosulfate, or chlorine.

In addition to acting as an anti-microbial agent, the purification material can effectively remove metal ions, such as mercury, lead, cadmium, iron, manganese, copper, nickel, chromium, barium, and arsenate, particularly when the purification material includes silver, an inorganic oxide such as alumina, and zinc. When zinc is included in the purification material, zinc ions can be released into the water which enhance disinfection of the water and provide algaestatic properties.

Other embodiments are within the claims.

What is claimed is:

1. A pool comprising:

a bottom portion;

a wall portion extending essentially vertically from said bottom portion, said bottom portion and said wall portion providing a volume;

a water-exchange fitting extending through said wall portion add opening into said volume; and a water purifier having a plurality of openings into said volume and comprising a purification material that can kill bacteria in water, said water purifier being removably connected to said water-exchange fitting and having a surface that, when connected to said water-exchange fitting, is substantially contiguous to said wall portion and said purification material being selected from the group consisting of particles larger than each of the plurality of openings and particles contained in a porous container.

2. The pool of claim 1 in which the water-exchange fitting is female threaded, further comprising a pump that is connected to said female-threaded water-exchange fitting.

3. The pool of claim 2, wherein said female-threaded water-exchange fitting is a water discharge fitting.

4. The pool of claim 1, wherein said water purifier further includes an exposed surface that extends into said volume, said exposed surface having rounded edges.

5. The pool of claim 1, wherein said water purifier extends less than 6 inches from said wall of said pool.

6. The pool of claim 5, wherein said water purifier extends less than 3 inches from said side of said pool.

7. The pool of claim 1, wherein said water purifier is circular.

8. The pool of claim 1, wherein said water purifier defines a chamber having an internal volume of between 30 and 80 cubic centimeters.

9. The pool of claim 8, wherein said internal volume is substantially filled by said purification material.

10. The pool of claim 1, wherein said water purifier further comprises an access through which said water purification material can be changed.

11. The pool of claim 1, wherein said volume is less than 7,500 gallons.

12. The pool of claim 1, wherein said purification material includes silver and a ceramic.

13. The pool of claim 1, wherein said volume contains water comprising an oxidizing agent dissolved in said water.

14. The pool of claim 13, wherein said oxidizing agent comprises ozone, potassium peroxymonosulfate or free available chlorine.

15. A pool according to claim 1 in which the purification material is selected from the group consisting of particles larger than each of the plurality of openings and comprises a monolithic foam.

16. A water purifier for killing bacteria in water located in a pool having (i) a volume defined by a wall portion and a bottom portion and (ii) a water-exchange fitting extending through said wall portion, said water purifier comprising:

a chamber for containing a purification material that kills bacteria in water, said chamber having an internal volume;

a water inlet that permits water to enter said water purifier, said water inlet having a fitting complementary and for connection to said water-exchange fitting;

a water outlet that permits water to exit said water purifier; and a fluid path located between said water inlet and said water outlet; and in which said purification material comprises a plurality of particles either larger than the water outlet or contained in a porous container; and said water purifier has a surface that, when connected to said water-exchange fitting, is substantially contiguous to said wall portion.

17. The water purifier of claim 16, further comprising an exposed surface having rounded edges.

18. The water purifier of claim 17, further comprising a housing containing said chamber and including said water inlet and said water outlet, said housing having a height of less than 6 inches.

19. The water purifier of claim 18, wherein said height is less than 3 inches.

20. The water purifier of claim 18, wherein said housing is circular.

21. The water purifier of claim 20, wherein said housing has a diameter of between 3 and 12 inches.

22. The water purifier of claim 16, wherein said internal volume is between 30 and 80 cubic centimeters.

23. A water purifier according to claim 16 in which the plurality of particles are larger than the water outlet and comprise a monolithic foam.

24. A water purifier for killing bacteria in water located in a pool having (i) a volume defined by a wall portion and a bottom portion and (ii) a water-exchange fitting extending through said wall portion, said water purifier comprising:

a chamber for containing a purification material that kills bacteria in water, said chamber having an internal volume;

a water inlet that permits water to enter said water purifier, said water inlet having a fitting complementary and for connection to said water-exchange fitting;

a water outlet that permits water to exit said water purifier;

a fluid path located between said water inlet and said water outlet; and a movable door for accessing said chamber and changing said purification material; and in which said water purifier has a surface that, when connected to said water-exchange fitting, is substantially contiguous to said wall portion.

* * * * *

UNITED STATES PATENT AND TRADEMARK OFFICE

CERTIFICATE OF CORRECTION

PATENT NO. : 5,766,456

DATED : June 16, 1998

INVENTOR(S) : Raymond P. Denkewicz, Jr., et al.

It is certified that error appears in the above-indentified patent and that said Letters Patent is hereby corrected as shown below:

Column 3, Line 43, Claim 1, Delete "add" and insert --and--

Signed and Sealed this

Twenty-seventh Day of July, 1999

*Attest:*

Q. TODD DICKINSON

*Attesting Officer*

*Acting Commissioner of Patents and Trademarks*